US006921301B2

(12) United States Patent
Conrad

(10) Patent No.: US 6,921,301 B2
(45) Date of Patent: Jul. 26, 2005

(54) BLADE-CONTACT SOCKET

(75) Inventor: Wolfgang Conrad, Schalksmühle (DE)

(73) Assignee: Lumberg Connect GmbH & Co. KG, Schalksmuhle (DE)

( * ) Notice: Subject to any disclaimer, the term of this patent is extended or adjusted under 35 U.S.C. 154(b) by 0 days.

(21) Appl. No.: 10/797,472

(22) Filed: Mar. 10, 2004

(65) Prior Publication Data

US 2004/0185722 A1 Sep. 23, 2004

(30) Foreign Application Priority Data

Mar. 11, 2003 (DE) ..... 103 10 899

(51) Int. Cl.[7] ..... H01R 11/22; H01R 13/11; H01R 4/18; H01R 4/28

(52) U.S. Cl. ..... 439/853; 439/857; 439/867; 439/775

(58) Field of Search ..... 439/853, 857, 439/867, 775, 608

(56) References Cited

U.S. PATENT DOCUMENTS 4,846,733 A * 7/1989 Baisz et al. ..... 439/622
5,219,294 A * 6/1993 Marsh et al. ..... 439/79
5,605,476 A * 2/1997 McNamara et al. ..... 439/608
6,210,240 B1 4/2001 Comerci ..... 439/853
6,672,886 B2 * 1/2004 Billman ..... 439/82
6,863,543 B2 * 3/2005 Lang et al. ..... 439/75

* cited by examiner

*Primary Examiner*—Chandrika Prasad
(74) *Attorney, Agent, or Firm*—Herbert Dubno

(57) ABSTRACT

A contact assembly for a contact blade has two outer sheet-metal combs of generally identical shape and each unitarily formed with a longitudinally throughgoing base strip lying in a respective base plane and having a pair of longitudinal edges and a plurality of forks each having a pair of contact arms projecting transversely from one of the edges of the respective base strip generally parallel to each other and to the respective base plane. The arms of each fork are spaced transversely of the respective base plane from each other and define a mouth open parallel to the respective base plane away from the respective one edge. The base strips are transversely juxtaposed with the mouths aligned and forming a blade-receiving slot open parallel to the base planes and with the forks of one of the combs interleaved with the forks of the other of the combs.

13 Claims, 8 Drawing Sheets

BLADE-CONTACT SOCKET

FIELD OF THE INVENTION

The present invention relates to an electrical socket assembly. More particularly this invention concerns such a socket assembly adapted to receive a flat blade contact.

BACKGROUND OF THE INVENTION

In order to transmit electrical current to or from a flat blade contact, it is standard to provide an electrical socket with a plurality of parallel spring contacts forming an elongated slot into which the blade can fit. Thus U.S. Pat. No. 6,210,240 of Comerci describes such a socket formed basically of a single piece of springy sheet metal bent to form two sets of contact fingers that in turn form the elongated blade-receiving slot. The fingers thus bear on opposite faces of a blade inserted into the socket so as to create a plurality of contact regions capable of transmitting considerable current, as for instance in a motor-vehicle fuse block. Medium currents of 16 amp and more and high currents of 50 amp and more can move through such a socket assembly.

The individual fingers of the socket assembly are deformed in the plane of the sheet metal forming them so they are quite springy. All of the contact fingers are therefore identical.

The problem with this construction is that the sheet metal must be specially stamped for each socket size. A socket for transmitting heavy current must have more such contact fingers than one transmitting less current. Thus the manufacturer must dispose of as many dies as there are socket sizes, greatly adding to production costs.

Another disadvantage of this type of socket is that it is necessary to provide as many fingers as possible in each socket, as they bear with relatively modest transverse force on the blade fitted to the socket. This has, once again, the disadvantage that each socket must be specifically designed for the load it is intended to carry.

OBJECTS OF THE INVENTION

It is therefore an object of the present invention to provide an improved contact assembly for a blade contact.

Another object is the provision of such an improved contact assembly for a blade contact which overcomes the above-given disadvantages, that is which can be mass produced at low cost from a simple basic part, and which grips the contact blade with great force.

SUMMARY OF THE INVENTION

A contact assembly for a contact blade has according to the invention two outer sheet-metal combs of generally identical shape and each unitarily formed with a longitudinally throughgoing base strip lying in a respective base plane and having a pair of longitudinal edges and a plurality of forks each having a pair of contact arms projecting transversely from one of the edges of the respective base strip generally parallel to each other and to the respective base plane. The arms of each fork are spaced transversely of the respective plane from each other and define a mouth open parallel to the respective base plane away from the respective one edge. The base strips are transversely juxtaposed with the mouths aligned and forming a blade-receiving slot open parallel to the base planes and with the forks of one of the combs interleaved with the forks of the other of the combs.

Thus in the simplest embodiment with only two combs, it is still possible to pack the arms closely enough together the transmit considerable current. By the simple expedient of sandwiching a third such comb between the two outer combs, one increases the number of teeth by 50%, thereby similarly increasing the current-transmitting capacity of the contact assembly.

According to the invention at least one of the combs is formed with a plurality of contact tabs projecting from the other of the edges of the respective base strip. These contacts can be seated in a printed circuit board. In fact in accordance both outer combs are formed at their other edges with contact tabs, and these contact tabs may be spaced so that actually grip a circuit board, that is engage on both sides of it, for a very solid mounting of the contact assembly. According to the invention the contact tabs can project generally perpendicular to the respective base planes. In addition when there are one or more middle combs sandwiched between the outer combs, these combs need not be provided with contact tabs. It is of course also within the scope of the invention to provide the middle comb, and only the middle comb, with the contact tabs.

The outer combs are mirror symmetrical to each other and according to the invention the forks lie in respective fork planes extending generally perpendicular to the respective main planes. Thus these forks will actually be spread by a contact blade inserted in the mouth formed by the fork slots in a direction parallel to their larger dimension. As a result they are not likely to deform plastically and will exert considerable force on the blade in the slot. Each of the combs in accordance with the invention is unitarily formed with respective twisted webs extending between the forks and the respective one longitudinal edge. Thus the forks of a simple flat stamping are twisted through 90° so that they lie perpendicular to the respective base strips, thereby simultaneously deforming a flat planar web into the twisted spiral web according to the invention.

The forks each include a base web between the respective arms and the respective twisted webs and the twisted webs extend offcenter from the respective base webs. Thus when the forks are twisted into their final position, the arms are offset from a center of the respective base web so that two such combs can be fitted symmetrically together.

In addition according to the invention the base strips are each formed between the forks with throughgoing weakening apertures so that the base strips can easily be cut at the apertures. Thus a workpiece blank can be formed as an endless band from which individual combs are cut, all in a continuous roll-stamping and -bending operation. For a long, high amperage connector the combs are long and for a short, low amperage connector they are short. Alternately, it is possible to sandwich together several combs and to cut them to length afterward.

The base strips are fixed to each other, typically by soldering. To this end they are formed with holes that align when they are sandwiched together so the solder can flow through and between them, solidly fixing the base strips, which can be of copper-coated steel or bronze, together.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
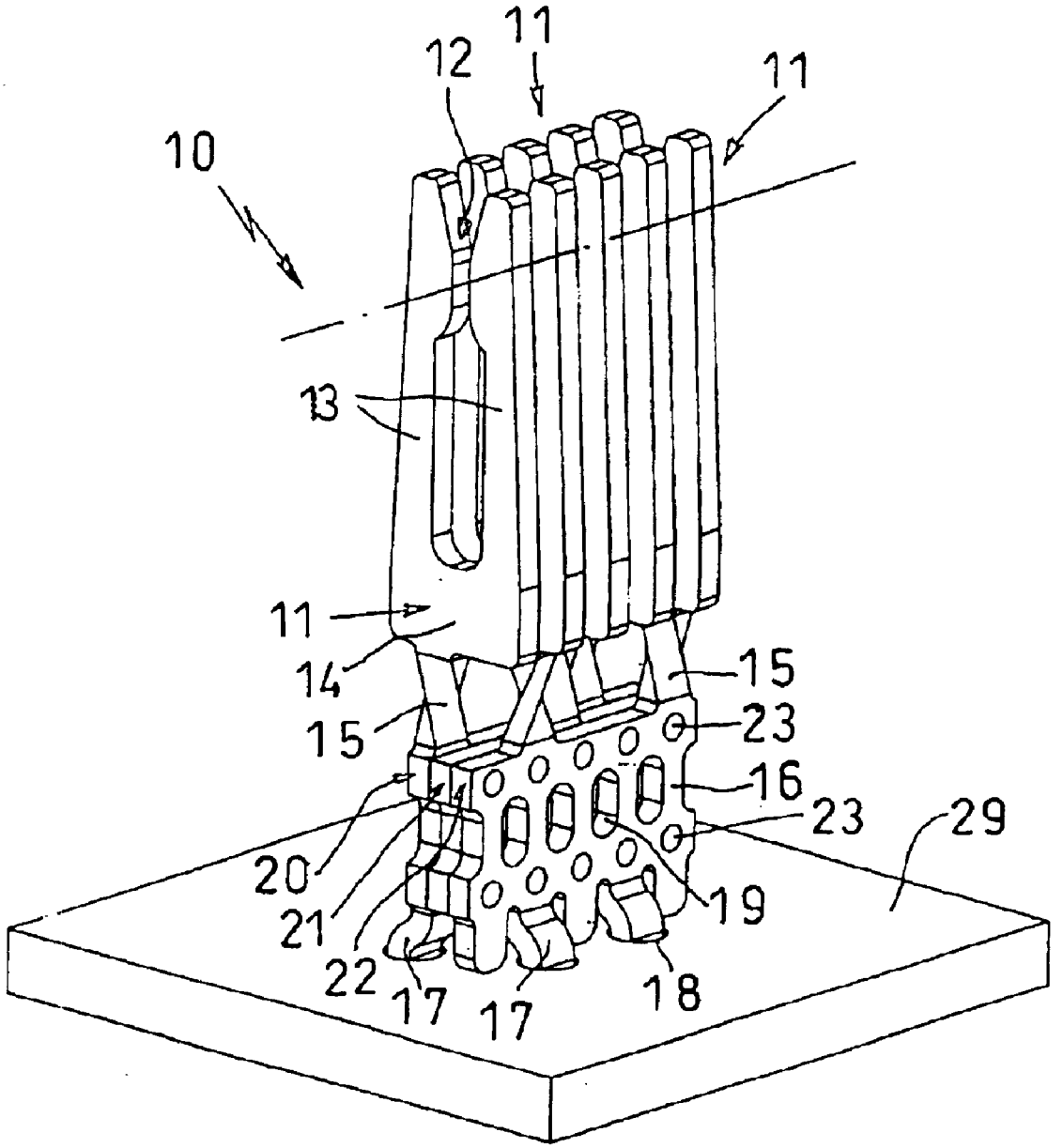
FIG. 1 is a perspective view of a contact assembly according to the invention.
Figure 2:
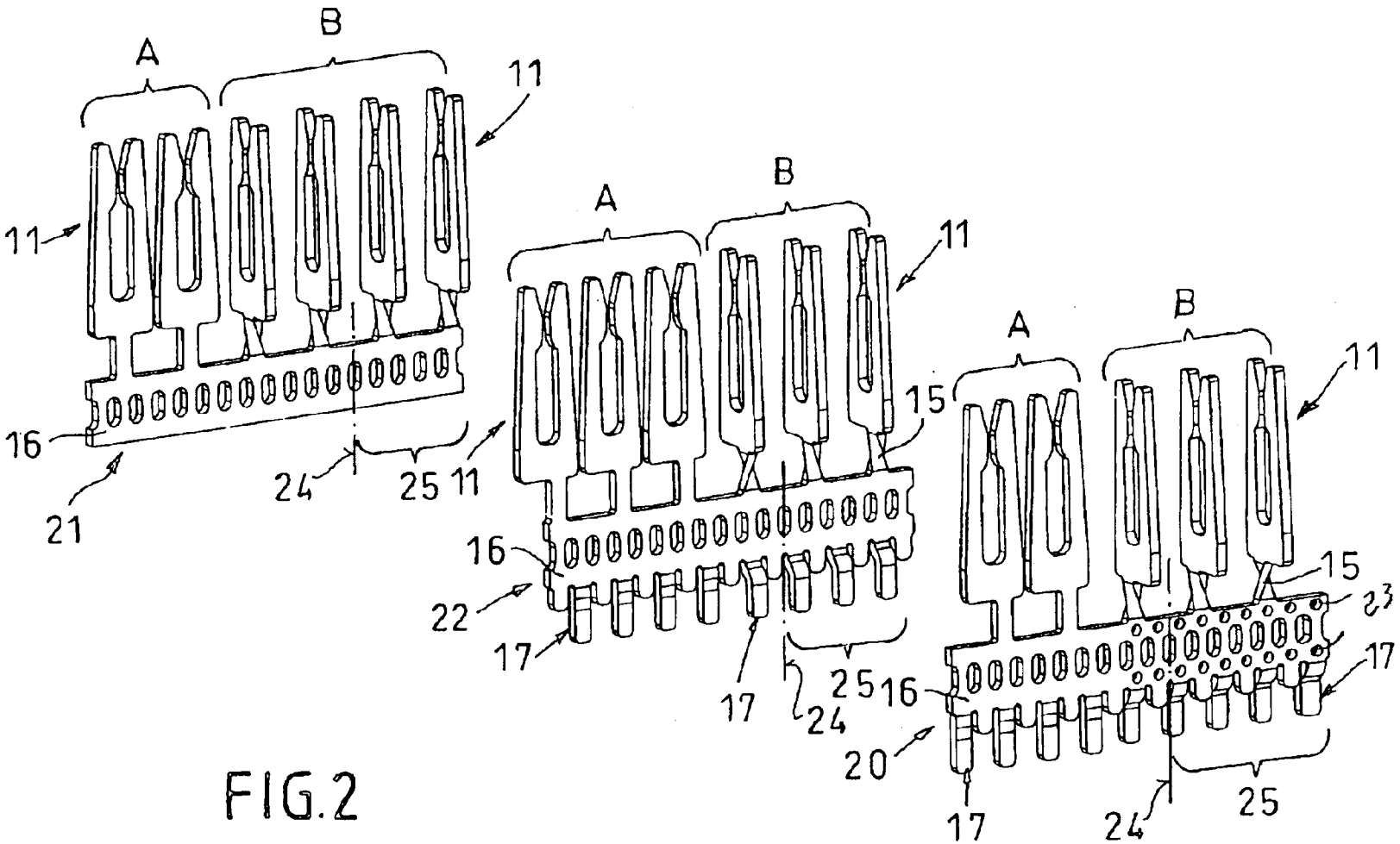
FIG. 2 is an exploded view of the contact assembly of FIG. 1 at an intermediate stage of manufacture.
Figure 7:
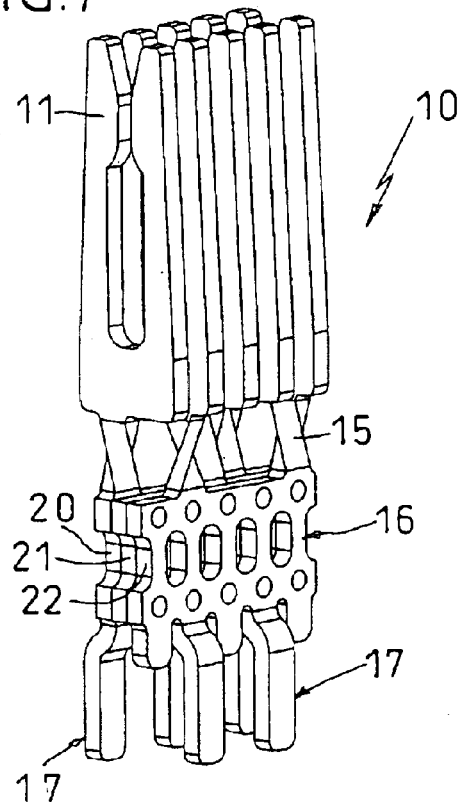
FIGS. 7, 8, and 9 are views of three variants on the system of FIG. 1.

As seen in FIGS. 1, 2, and 7 a contact assembly 10 according to the invention comprises a plurality of bronze contact forks 11 each having a pair of arms 13 defining a slot 12 s extending in a direction perpendicular to the plane of each fork 11. The arms 13 are joined at a common bight or base 14 connected via a twisted web 15 to a base strip 16 extending in a plane parallel to the slot 12.

Here there are three substantially identical combs 20, 21, and 22 each formed by one base strip 16, a plurality of twisted webs 15, and one fork 11 on each web 15. The strips 16 lie flatly against each other, with the strip 16 of the comb 21 sandwiched between those of the combs 20 and 22. The strips 16 of the combs 20 and 22 are formed with downwardly projecting connector tabs 17 that may fit in holes 18 (FIG. 1 only) of a printed circuit plate 29, while the strip 16 of the middle comb 21 has no such tabs 17. Holes 23 in the strips 18 allow them to be secured together by riveting or soldering, and the strips 16 are formed with a row of throughgoing apertures 19 that lighten them and allow them to be subdivided easily into sections as described below.

Figure 8:
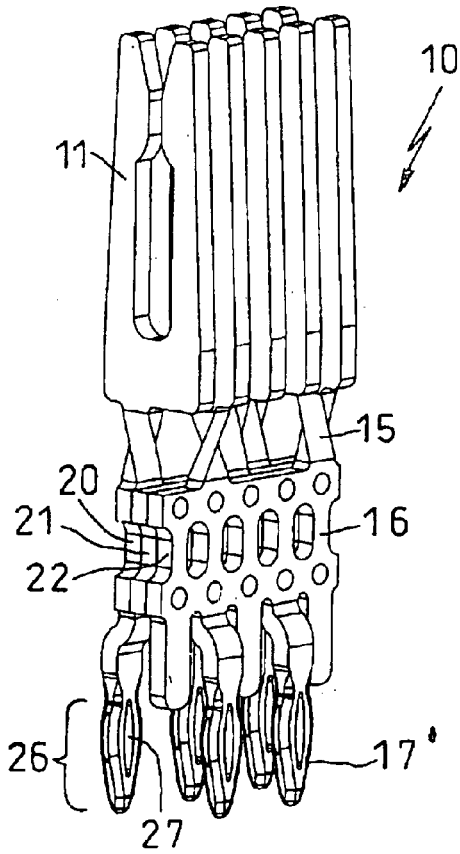
Figure 9:
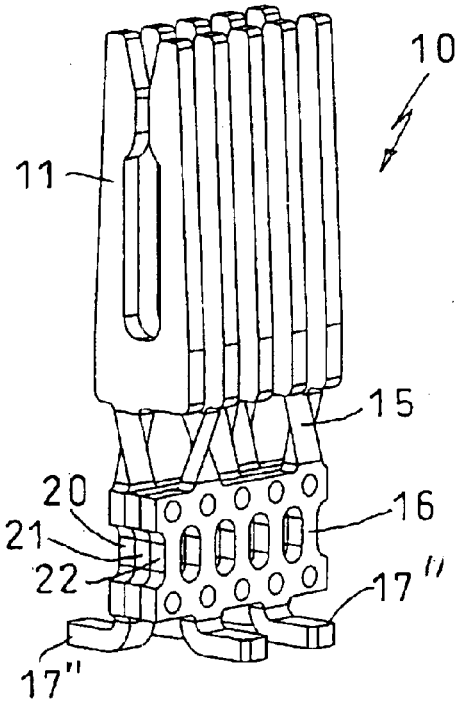
Figure 11:
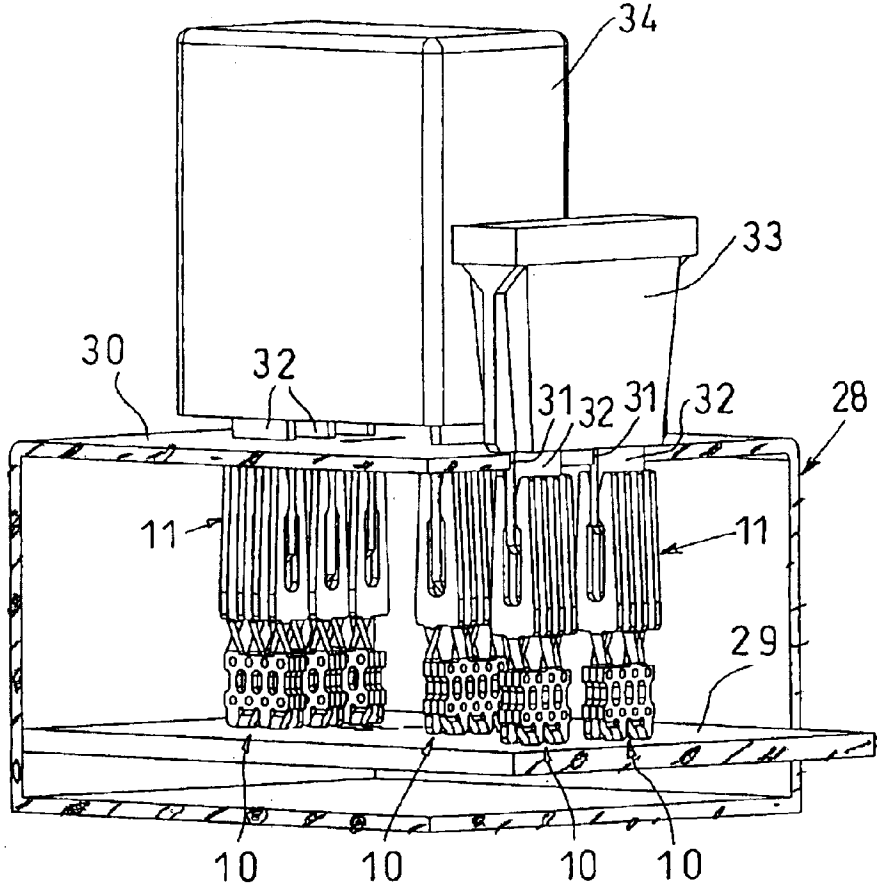
FIG. 11 is a perspective sectional view of the box of FIG. 10.

Instead of the downwardly directed tabs 17 of FIGS. 1 and 7, it is possible as shown in FIG. 8 to provide tabs 17' having sections 26 spread by slots 27 for a spring fit in the holes 18. It is also possible as shown in FIG. 9 to provide bent-back tabs 17" that can be soldered flat, SMT style, to the circuit board 29.

Figure 3:
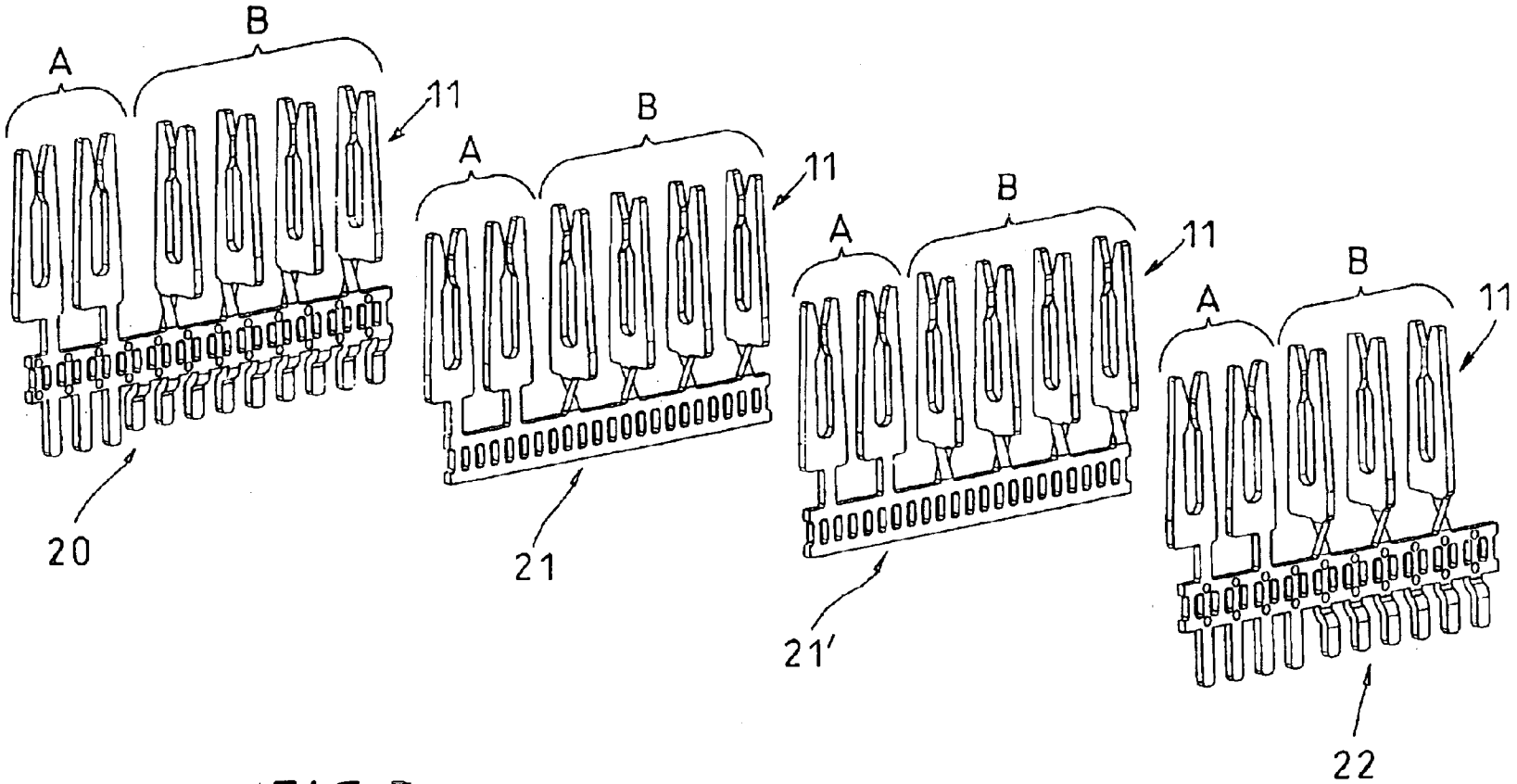
FIG. 3 is a view like FIG. 2 showing manufacture of an alternative contact assembly in accordance with the invention.
Figure 4:
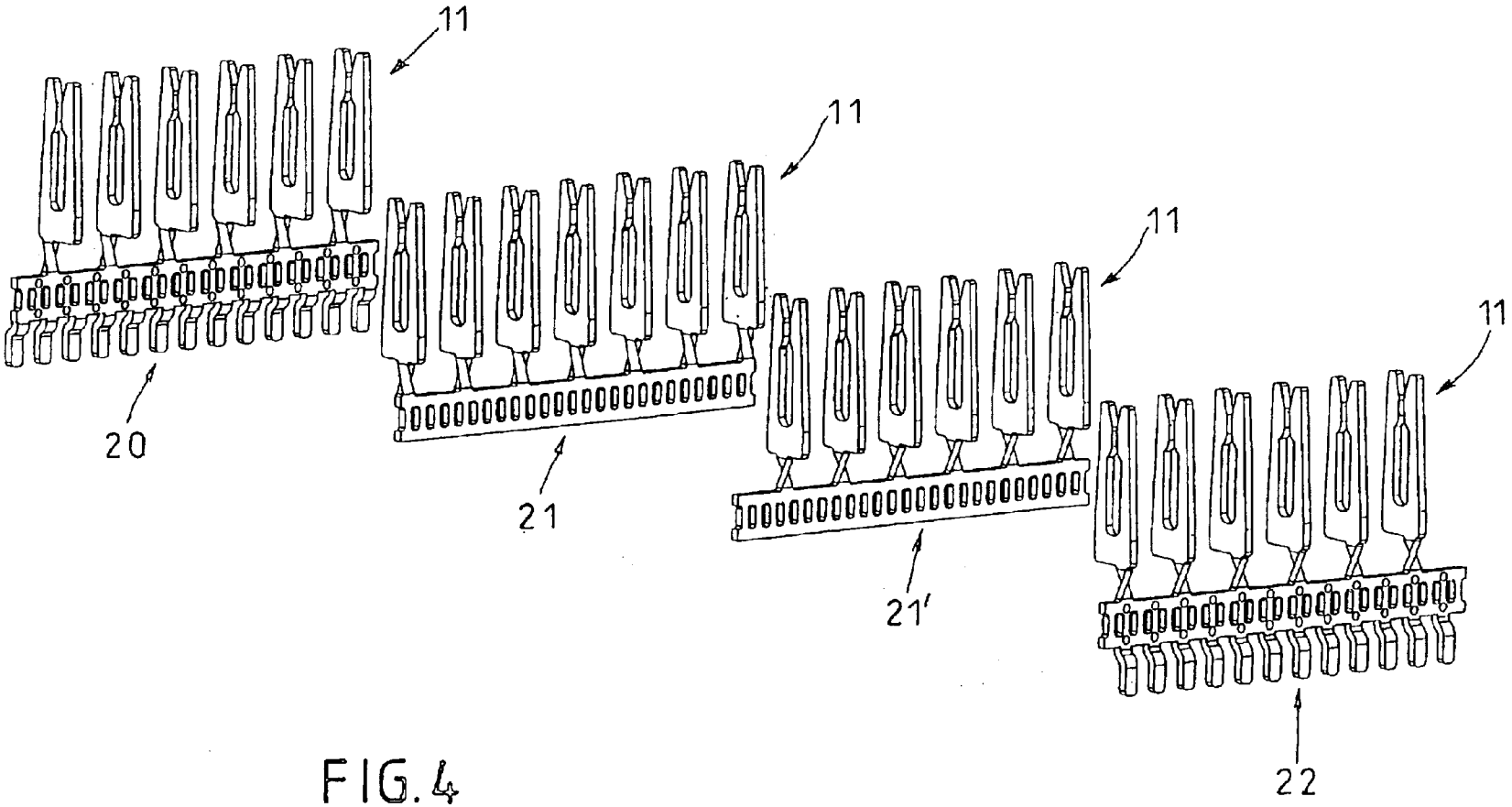
FIG. 4 is an exploded view illustrating the assembly of FIG. 3 at a further stage of manufacture.

FIGS. 2–5 and 6*a*–6*c* show the construction of the assembly 10 and of another contact assembly 10' made of the three combs 20, 21, and 22 as described above, plus a second tab-free comb 21' that is sandwiched between the combs 21 and 22. More particularly FIG. 3 shows how initially the combs 20–22 are produced as shown in sections A as flat stampings with the forks 11 coplanar with the strips 16. Then as shown in sections B the forks 11 are all twisted through 90° about respective parallel center axes coplanar with the plane of the strip 16. Then the stampings are cut into sections 25 as shown at lines 24. The tab-free comb 16 can be made of a separate stamping, or the tabs 17 can simply be sheared off a stamping like that used to make the combs 20 or 22. FIG. 4 shows how all the forks 11 are twisted through 90°.

Figure 5:
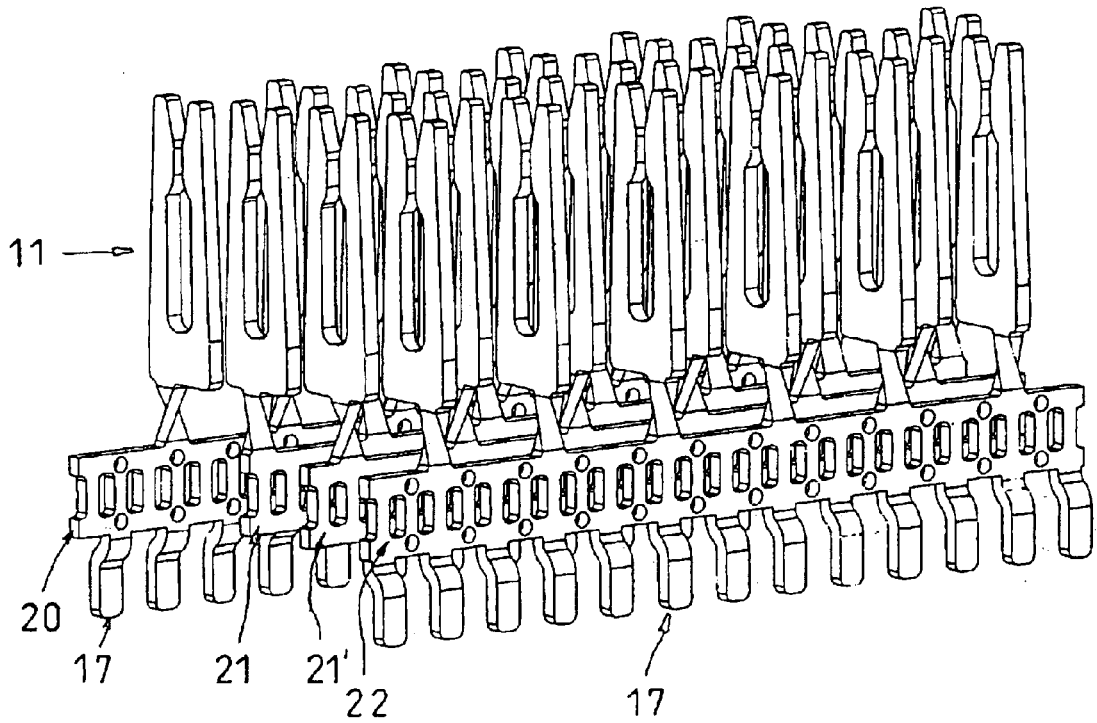
FIG. 5 is a view of the FIG. 3 assembly in an final stage of assembly.
Figure 6B:
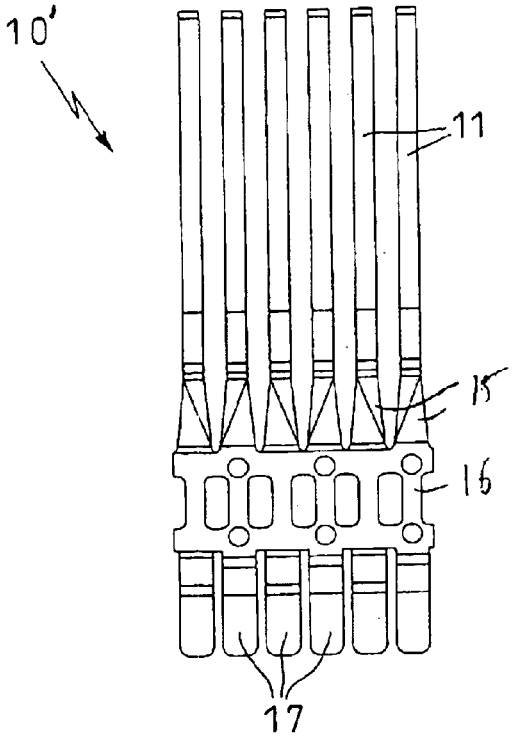
FIGS. 6*a*, 6*b*, and 6*c* are perspective, side, and end views of the contact assembly of FIGS. 3–5.
Figure 6C:
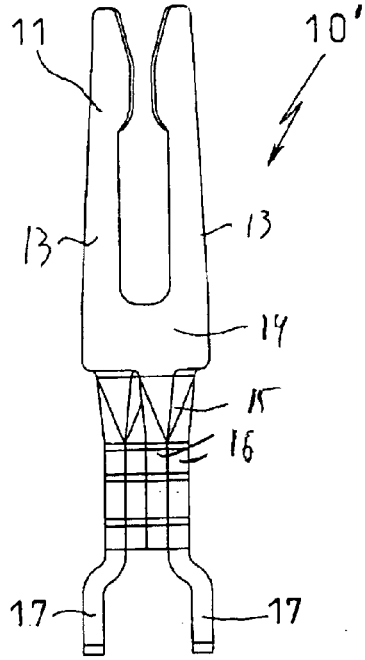
Figure 6A:
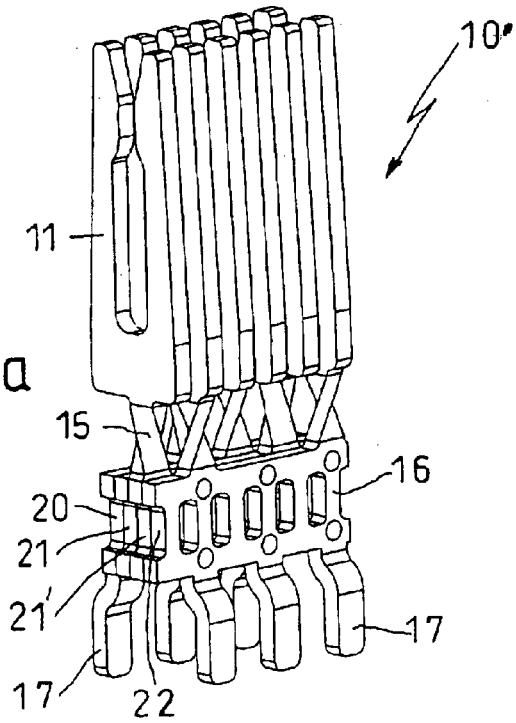

FIG. 5 shows how the combs 20, 21, 21' and 22 are then interleaved with the forks 11 fitting between each other. Of course for a three-layer assembly 10 there is no comb 21', but otherwise the construction is identical. The combs 20–22 are fitted together until the strips 16 flatly engage one another, and then these strips 16 are fixed together, typically by soldering. The forks 11 can lie longitudinally against each other or be slightly longitudinally spaced.

Figure 10:
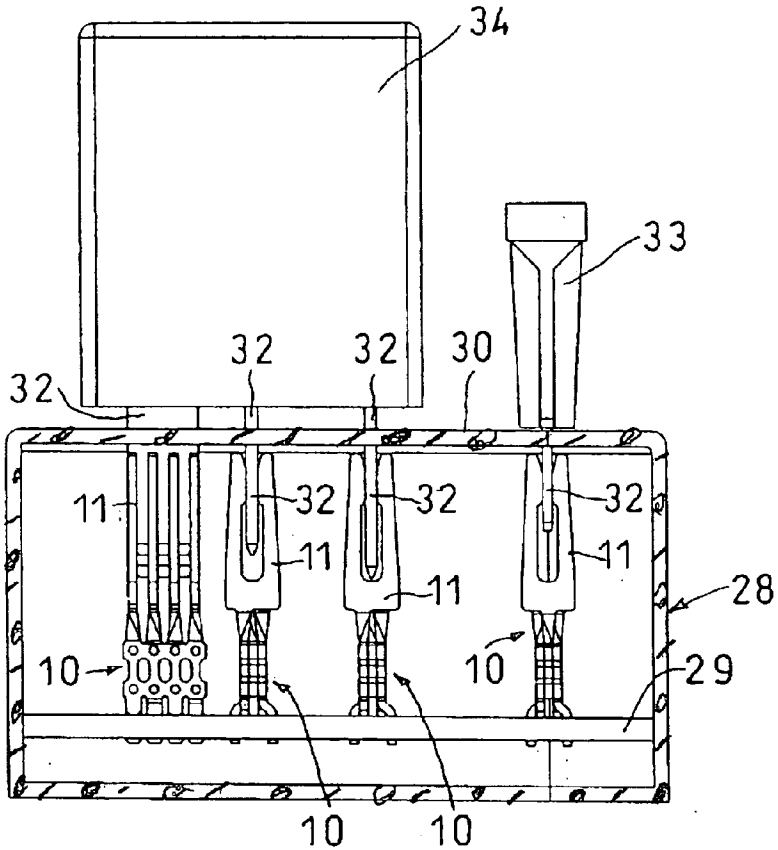
FIG. 10 is a cross section through a connector box incorporating the assembly of this invention.

FIG. 10 shows a connector box 28 fitted with four contact assemblies 10 all secured to a common printed circuit board 29 as also shown in FIG. 1. A top wall 30 of the box 28 is formed with throughgoing slots 31 through which blades 32 of a fuse 33 and a relay 34 can seat in the slots 12 between the arms 14 of the forks 11. Since the arms 14 are pushed apart parallel to the planes of the respective forks 11, they exert considerable spring force and grip the blades 32 very tightly.

I claim:

1. A contact assembly for a contact blade, the assembly comprising two outer sheet-metal combs of generally identical shape and each unitarily formed with a longitudinally throughgoing base strip lying in a respective base plane and having a pair of longitudinal edges and a plurality of forks each having a pair of contact arms projecting transversely from one of the edges of the respective base strip generally parallel to each other and to the respective base plane, the arms of each fork being spaced transversely of the respective base plane from each other and defining a mouth open parallel to the respective base plane away from the respective one edge, the base strips being transversely juxtaposed with the mouths aligned and forming a blade-receiving slot open parallel to the base planes and with the forks of one of the combs interleaved with the forks of the other of the combs.

2. The contact assembly defined in claim 1 wherein one of the combs is formed with a plurality of contact tabs projecting from the other of the edges of the respective base strip.

3. The contact assembly defined in claim 2 wherein the contact tabs project generally perpendicular to the respective base planes.

4. The contact assembly defined in claim 1 further comprising a middle sheet-metal comb generally identical to the first inner combs and sandwiched therebetween with the forks of the middle comb interleaved with the forks of the outer combs.

5. The contact assembly defined in claim 4 wherein the outer combs are both formed at their other edges with contact tabs.

6. The contact assembly defined in claim 4 wherein the outer combs are mirror symmetrical to each other.

7. The contact assembly defined in claim 1 wherein the forks lie in respective fork planes extending generally perpendicular to the respective main planes.

8. The contact assembly defined in claim 1 wherein each of the combs is unitarily formed with respective twisted webs extending between the forks and the respective one longitudinal edge.

9. The contact assembly defined in claim 8 wherein the forks each include a base web between the respective arms and the respective twisted webs and the twisted webs extend offcenter from the respective base webs.

10. The contact assembly defined in claim 1 wherein the base strips are each formed between the forks with throughgoing weakening apertures, whereby the base strips can easily be cut at the apertures.

11. The contact assembly defined in claim 1, further comprising means fixing the base strips to each other.

12. The contact assembly defined in claim 1 wherein the base strips and fingers are of the same thickness.

13. A contact assembly for a contact blade, the assembly comprising two outer and one middle sheet-metal combs of similar construction and each unitarily formed with a longitudinally throughgoing base strip lying in a respective base plane and having a pair of longitudinal edges, a plurality of forks lying in respective base planes perpendicular to the base planes and each having a pair of contact arms projecting transversely from one of the edges of the respective base strip generally parallel to each other and to the respective base plane, the arms of each fork being spaced transversely of the respective base plane from each other and defining a mouth open parallel to the respective base plane away from the respective one edge, and respective twisted webs connecting the respective forks with the respective one edge, the base strips being transversely juxtaposed with the mouths aligned and forming a blade-receiving slot open parallel to the base planes and with the forks of one of the combs interleaved with the forks of the other of the combs.

* * * * *